US006094143A

United States Patent [19]

Nakajima et al.

[11] Patent Number: 6,094,143

[45] Date of Patent: Jul. 25, 2000

[54] LIGHT OBSTRUCTION TYPE SMOKE SENSOR

[75] Inventors: Satoshi Nakajima; Isao Asano, both of Tokyo, Japan

[73] Assignee: Hochiki Corporation, Tokyo, Japan

[21] Appl. No.: 09/231,074

[22] Filed: Jan. 14, 1999

[30] Foreign Application Priority Data

Feb. 5, 1998 [JP] Japan ..... 10-024358

[51] Int. Cl.[7] ..... G08B 17/00

[52] U.S. Cl. ..... 340/630; 340/578; 340/584; 340/630; 250/574; 356/438

[58] Field of Search ..... 340/577, 578, 340/584, 628, 630; 250/574, 575; 356/436, 437, 438, 439

[56] References Cited

U.S. PATENT DOCUMENTS

| | | | |
|---|---|---|---|
| 4,695,734 | 9/1987 | Honma et al. | 250/573 |
| 4,930,095 | 5/1990 | Yuchi et al. | 364/571.01 |
| 5,574,435 | 11/1996 | Mochizuki | 340/630 |
| 5,705,988 | 1/1998 | McMaster | 340/630 |
| 5,708,414 | 1/1998 | Peltier et al. | 340/630 |
| 5,831,537 | 11/1998 | Marman | 340/630 |
| 5,864,293 | 1/1999 | Lewiner et al. | 340/630 |

FOREIGN PATENT DOCUMENTS

| | | | |
|---|---|---|---|
| 0 629 983 | 12/1994 | European Pat. Off. | G08B 17/103 |
| 2074721 | 11/1981 | United Kingdom | G08B 17/10 |
| 2095821 | 10/1982 | United Kingdom | G08B 17/10 |
| 2267963 | 12/1993 | United Kingdom | G08B 17/103 |
| 2314618 | 1/1998 | United Kingdom | G08B 17/107 |

*Primary Examiner*—Daniel J. Wu

*Attorney, Agent, or Firm*—Sughrue, Mion, Zinn, Macpeak & Seas, PLLC

[57] ABSTRACT

A driving unit generates a driving current corresponding to a light generation control signal CTL supplied from a light generation controlling unit. The driving current is supplied to an LED. Light emitted from the LED impinges on a light receiving circuit through a space of a monitoring area. The received light level of the light receiving circuit is converted into a received light level signal RLV in an A/D. The received light level signal RLV is supplied to a smoke detecting unit and the light generation controlling unit. The received light level signal RLV is monitored in a short period by the smoke detecting unit. When the received light level signal RLV is equal to or lower than an alarm level, an alarm signal ALM is output. The light generation controlling unit compares the received light level signal RLV with a reference level in a long period. The light generation control signal CTL is increased or decreased so that the level difference between the received light level signal RLV and the reference level is eliminated.

1 Claim, 2 Drawing Sheets

LIGHT OBSTRUCTION TYPE SMOKE SENSOR

BACKGROUND OF THE INVENTION

1. Field of the Invention

The present invention relates to a light obstruction type smoke sensor (hereinafter, referred to merely as a "sensor") which detects attenuation of light arriving at a light receiving unit from a light generating unit through a space of a monitoring area, and which senses an existence of smoke caused by a fire or the like, and more particularly to a control of the quantity of light of the light generating unit.

2. Description of the Related Art

FIG. 2 is a diagram showing the configuration of a conventional sensor.

The sensor has two terminals 1*a* and 1*b* for connecting the sensor to a receiver or a repeater via sensor lines which are not shown. The sensor receives a power supply of DC 24 V from the receiver or the repeater via the sensor lines.

A warning circuit 2 and a constant voltage circuit 3 are connected to the terminals 1*a* and 1*b*. The warning circuit 2 short-circuits the terminals 1*a* and 1*b* based on an alarm signal ALM, and causes a current of a predetermined level or higher to flow through the sensor lines. The constant voltage circuit 3 generates a stabilized supply voltage VP of DC 10 V which is required for circuits in the sensor, from the power source of DC 24 V supplied via the sensor lines.

A light generating circuit 4, a light receiving circuit 5, and a smoke detection processing circuit 6 are connected to an output side of the constant voltage circuit 3. The light generating circuit 4 consists of a light-emitting diode (hereinafter, referred to as an "LED") and the like, and emits light of constant luminance. The light receiving circuit 5 consists of a phototransistor and the like. The light receiving circuit receives the light which arrives from the light generating circuit 4 through a space of a monitoring area, and outputs an analog voltage corresponding to the received light level.

The smoke detection processing circuit 6 consists of an analog/digital converter (hereinafter, referred to as an "A/D") 6*a* and a microprocessor (hereinafter, referred to as an "MPU") 6*b*. The analog voltage corresponding to the received light level is supplied from the light receiving circuit 5 to an input side of the A/D 6*a*. The A/D 6*a* converts the input analog voltage to a digital value, and outputs the digital value. An output side of the A/D is connected to the MPU 6*b*. The MPU 6*b* has a function of monitoring the received light level of the light receiving circuit 5, and also has a function of, when an abrupt change of the received light level is detected, outputting an alarm signal ALM. The alarm signal ALM output from the MPU 6*b* is supplied to the warning circuit 2.

In the sensor, the supply voltage VP of 10 V is generated by the constant voltage circuit 3 from the voltage of DC 24 V supplied via the sensor lines, and then supplied to the light generating circuit 4, the light receiving circuit 5, and the smoke detection processing circuit 6. Accordingly, light of a constant level is output from the light generating circuit 4, and the light enters the phototransistor of the light receiving circuit 5 through the space of the monitoring area. If any shielding material such as smoke does not exist in an optical path between the light generating circuit 4 and the light receiving circuit 5, an analog voltage of a predetermined level is obtained in the light receiving circuit 5. The analog voltage obtained in the light receiving circuit 5 is converted into a digital value in the A/D 6*a* and then supplied to the MPU 6*b*.

The MPU 6*b* periodically monitors data of received light levels supplied from the A/D 6*a*, and compares the data with a reference value which is obtained from an average value of several sets of preceding data. If the difference between the new data and the reference value is equal to or lower than a predetermined allowable variation width, it is not judged that a fire occurs, and the reference value is corrected by the new data.

If the new data is lowered so as to exceed the allowable variation width, it is judged that a fire occurs, and an alarm signal ALM is output from the MPU 6*b* to the warning circuit 2. When the alarm signal ALM is supplied to the warning circuit 2, the warning circuit 2 short-circuits the terminals 1*a* and 1*b* with a given impedance. Accordingly, a predetermined short-circuit current flows through the sensor lines, so that the alarm can be detected by the receiver or the repeater on the side of the power supply.

However, the above-described conventional sensor has the following problems.

The light generating circuit 4 is driven by the constant supply voltage VP of DC 10 V supplied from the constant voltage circuit 3, so that light of constant luminous intensity is output. On the other hand, a gentle variation of the received light level of the light receiving circuit 5 is corrected in the smoke detection processing circuit 6, and a fire is judged by using the corrected average received light level as a reference value.

Such a correction is performed only in the light receiving side. Accordingly, if the received light level is gradually lowered by a reason such as deterioration of the LED, deviation of the optical path between the light generation side and the light receiving side and caused by deformation of the building or the change of installing conditions, or a soiled reflecting mirror in the optical path, the judgment on a fire is performed by using the lowered received light level as the reference value. When the received light level which will be used as the reference value is gradually lowered, therefore, the signal-to-noise ratio is deteriorated and there occurs deviation in sensitivity, so that it may be impossible to accurately perform the judgment on a fire.

In the installation of a sensor, it is necessary to set initial conditions in view of the variation in the quantity of receiving light. This produces a problem in that the allowable range which is set as an initial value of the received light level is narrow and hence the adjustment requires a prolonged time period.

SUMMARY OF THE INVENTION

It is an object of the present invention to provide a sensor capable of accurately performing a fire judgment on the light receiving side, and easily performing the adjustment in the installation.

According to the present invention, the sensor comprises: driving means for receiving a light generation control signal for a luminance control, and for outputting a driving current corresponding to the light generation control signal; light generating means for outputting light of luminance corresponding to the driving current; light receiving means for receiving light which is output from the light generating means and passes through a space of a monitoring area, and for outputting a level of the received light; light generation controlling means for comparing the received light level with a predetermined reference level, for, when a difference of the levels is in an allowable range, increasing or decreasing the light generation control signal to reduce the level difference, and for then outputting the light generation control signal; and smoke sensing means for detecting smoke in an optical path between the light generating means and the light receiving means based on the received light level, and for outputting an alarm signal when the received light level is equal to or lower than a predetermined alarm level.

According to the invention, the sensor is configured as described above and hence can perform the following functions.

The light which is output from the light generating means and arrives at the light receiving means through the space of the monitoring area is received by the light receiving means, and the level of the received light is output. In the light generation controlling means, the received light level is compared with the reference level. If the level difference is in an allowable range, the light generation control signal is output while the signal is increased or decreased so as to reduce the level difference. The light generation control signal is supplied to the driving means, and a driving current corresponding to the light generation control signal is output to the light generating means. Then, light of luminance corresponding to the driving current is output from the light generating means.

By contrast, if the received light level is equal to or lower than an alarm level, an alarm signal is output from the smoke detecting means.

PREFERRED EMBODIMENT OF THE INVENTION

Preferred embodiment according to the present invention will be described as follows referring to the accompanying drawings.

Figure 1:
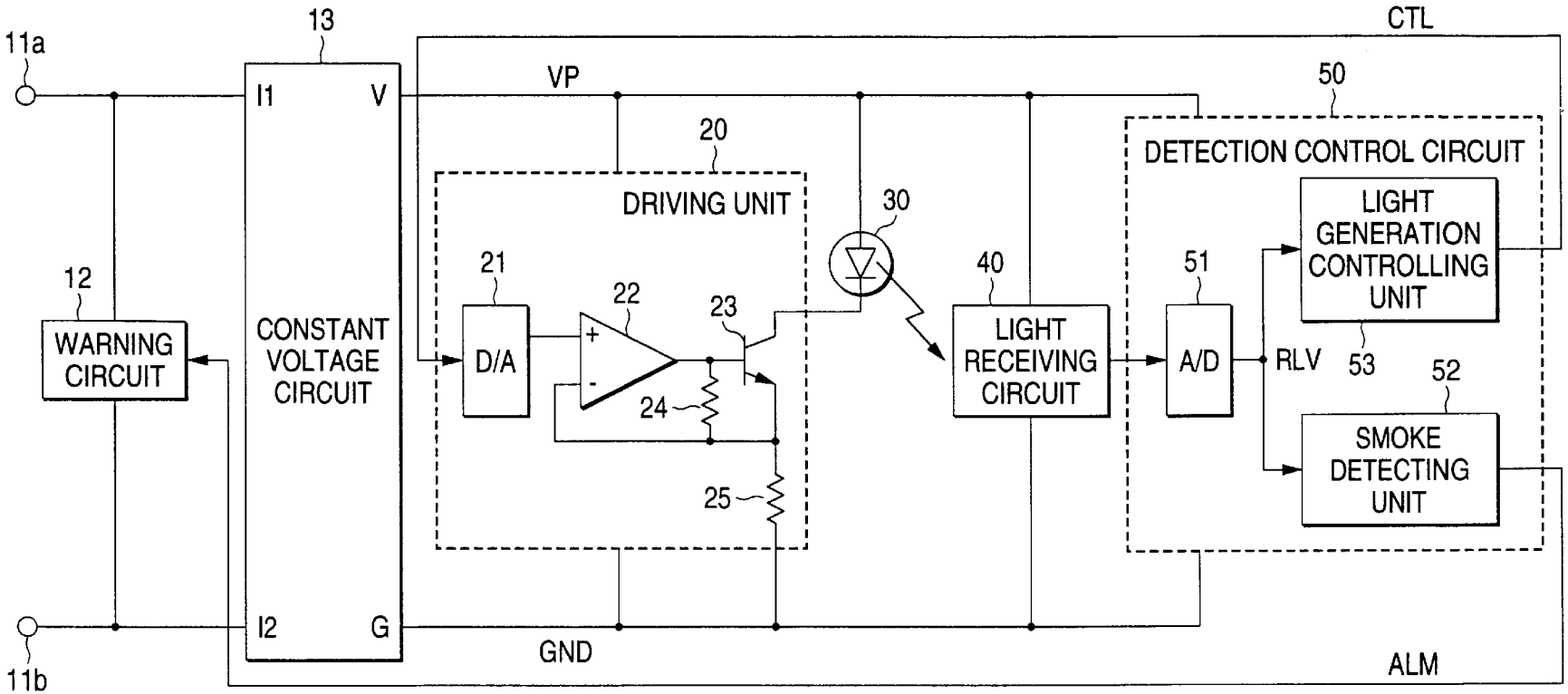
FIG. 1 is a diagram showing the configuration of a sensor which is an embodiment of the invention.

FIG. 1 is a diagram showing the configuration of a sensor which is an embodiment of the invention.

Figure 2:
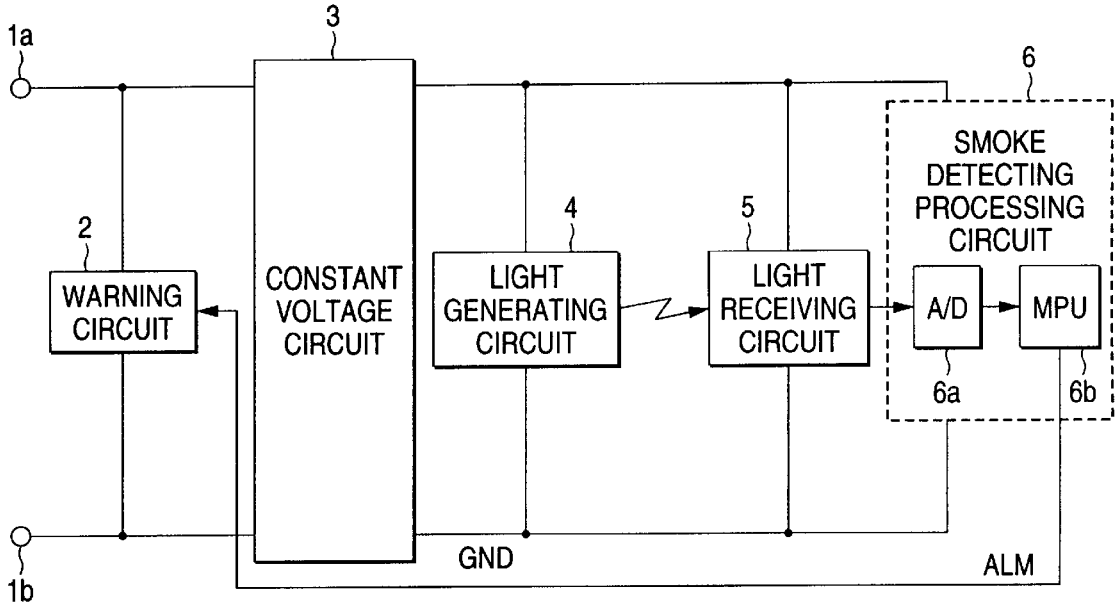
FIG. 2 is a diagram showing the configuration of a conventional sensor.

In the same manner as the sensor of FIG. 2, the sensor has two terminals 11*a* and 11*b* for connecting the sensor to a receiver or a repeater via a pair of sensor lines which are not shown, and is supplied with a power of DC 24 V from the receiver or the repeater via the sensor lines.

A warning circuit 12 and a constant voltage circuit 13 are connected to the terminals 11*a* and 11*b*. The warning circuit 12 short-circuits the terminals 11*a* and 11*b* based on an alarm signal ALM, and causes a current of a predetermined level or higher to flow through the sensor lines, so as to transmit an alarm to the receiver or the repeater. The constant voltage circuit 13 generates a stabilized supply voltage VP of, for example, DC 10 V which is required for the inside of the sensor, from the power source of DC 24 V which is supplied via the sensor lines. The constant voltage circuit 13 outputs a ground voltage GND from an output terminal G, and the supply voltage VP of 10 V from an output terminal V, irrespective of the polarity of the voltage of DC 24 V applied to input terminals I1 and I2.

A driving unit 20, an LED 30, a light receiving circuit 40, and a detection control circuit 50 are connected to the output terminals G and V of the constant voltage circuit 13.

The driving unit 20 drives the LED 30 at a level corresponding to a light generation control signal CTL, and consists of a digital/analog converter (hereinafter, referred to as a "D/A") 21, an operational amplifier 22, a transistor 23, and resistors 24 and 25.

The D/A 21 converts the light generation control signal CTL supplied in the form of, for example, an 8-bit digital value (0 to 255), into an analog voltage. The output of the D/A is connected to the noninverting (+) input terminal of the operational amplifier 22. The output of the operational amplifier 22 is connected to the base of the NPN transistor 23. The bias resistor 24 is connected between the base and the emitter of the transistor 23. The emitter of the transistor 23 is connected to the inverting (−) input terminal of the operational amplifier 22, and also to the ground voltage GND via the resistor 25 for adjusting a driving current. The cathode of the LED 30 is connected to the collector of the transistor 23. The anode of the LED 30 is connected to the supply voltage VP.

The light receiving circuit 40 consists of a phototransistor and receives the light which is emitted from the LED 30 and arrives through a space of a monitoring area. The light receiving circuit outputs an analog voltage corresponding to the received light level.

The detection control circuit 50 consists of an A/D 51, a smoke detecting unit 52, and a light generation controlling unit 53. The analog voltage from the light receiving circuit 40 is supplied to the A/D 51. A received light level signal RLV of an 8-bit digital value (0 to 255) which is converted in the A/D 51 is supplied to the smoke detecting unit 52 and the light generation controlling unit 53.

The smoke detecting unit 52 monitors the received light level signal RLV in a period of, for example, three seconds. When it is detected that the received light level signal RLV is lowered to a level which is equal to or lower than a predetermined alarm level ALVL, the smoke detecting unit 52 judges that smoke corresponding to a fire exists in an optical path between the LED 30 and the light receiving circuit 40, and outputs an alarm signal ALM to the warning circuit 12.

In the light generation controlling unit 53, an initial received light level obtained when the sensor is installed and the LED 30 and the light receiving circuit 40 are adjusted is set as a reference level SLV. The light generation controlling unit 53 compares the received light level signal RLV supplied from the A/D 51 with the reference level SLV at intervals longer than the monitoring period of the smoke detecting unit (for example, intervals of ten minutes). When the level difference between the received light level signal RLV and the reference level SLV is in an allowable range (for example, in the range of ±5), the light generation controlling unit outputs the light generation control signal CTL for the driving unit 20 while increasing or decreasing the value of the light generation control signal CTL so that the received light level signal RLV becomes closer to the reference level SLV.

Figure 3:
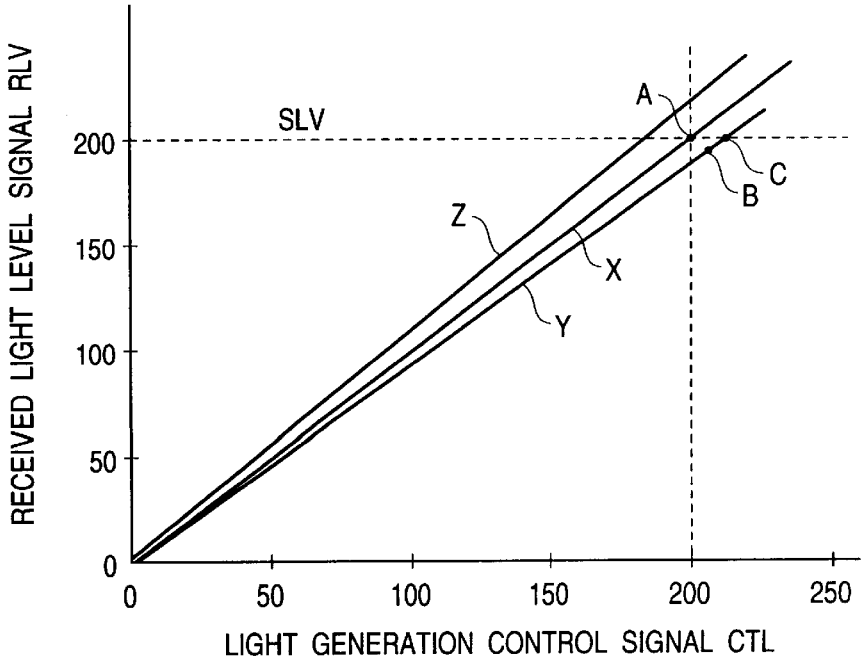
FIG. 3 is a view showing relationships between a light generation control signal CTL and a received light level signal RLV which are shown in FIG. 1.

FIG. 3 is a view showing relationships between the light generation control signal CTL and the received light level signal RLV which are shown in FIG. 1. The abscissa indicates the light generation control signal CTL output from the light generation controlling unit 53, and the ordinate indicates the received light level signal RLV output from the A/D 51.

Next, referring to FIG. 3, (1) the adjusting method in the installation of the sensor shown in FIG. 1, (2) the fire detecting operation, and (3) the light generation control operation will be separately described.

(1) Adjusting Method in the Installation

In the case of a sensor of the transmitter/receiver separation type (projected beam type), the LED 30 and the sensor main unit including the components other than the LED, namely, the driving unit 20 and the light receiving circuit 40 are oppositely attached with interposing the space of the monitoring area therebetween. The directional adjustment is roughly performed so that their optical axes coincide with each other.

In the case of a sensor of the integral type, the sensor is attached to one end of the space of the monitoring area. A reflector such as a mirror is attached to the other end of the space of the monitoring area. The direction of the sensor and the angle of the reflector are adjusted so that the light emitted from the LED 30 of the sensor is reflected from the reflector and then impinges on the light receiving circuit 40.

Next, the value of the light generation control signal CTL is set to be about 80% (for example, 200) of the maximum value (that is, 255) by using, for example, a tester. Thereafter, the signal is supplied to the driving unit 20. Accordingly, light is emitted from the LED 30 to impinge on the light receiving circuit 40. The A/D 51 outputs the received light level signal RLV corresponding to the received light level, in the form of a digital value.

While the received light level signal RLV is monitored by the tester or the like, the angles of the components of the optical system such as the sensor main unit, the LED 30, and the reflector are finely adjusted. These optical components are fixed at respective positions where the received light level signal RLV is the maximum.

After the optical components are fixed, the resistance of the resistor 25 of the driving unit 20 is adjusted so that the received light level signal RLV is about 80% (for example 200) of the maximum value (that is, 255). As a result, the adjustment in the installation of the sensor is completed, and the relationships between the light generation control signal CTL and the received light level signal RLV are set so as to have the characteristics shown by the solid line X in FIG. 3. The digital value (that is, 200) of the received light level signal RLV used in the adjustment in the installation is set in the light generation controlling unit 53 as the reference level SLV.

(2) Fire Detecting Operation

The stabilized supply voltage VP of 10 V is generated in the constant voltage circuit-13 from the voltage of DC 24 V supplied via the sensor lines, and then supplied to the driving unit 20, the LED 30, the light receiving circuit 40, and the detection control circuit 50, so that the monitoring operation is started. Accordingly, the light generation control signal CTL is converted into an analog voltage in the D/A 21, and the analog voltage is supplied to the operational amplifier 22. The output signal of the operational amplifier 22 is supplied to the base of the transistor 23. The LED 30 is driven by the driving current which is controlled by the transistor 23.

The light emitted from the LED 30 impinges on the light receiving circuit 40 through the space of the monitoring area, and an analog voltage corresponding to the received light level is obtained. The analog voltage obtained in the light receiving circuit 40 is converted into the received light level signal RLV by the A/D 51, and then supplied to the smoke detecting unit 52. In the smoke detecting unit 52, the received light level signal RLV input from the A/D 51 is compared with an alarm level (for example, a digital value of 150) for every three seconds.

If the received light level signal RLV is equal to or higher than the alarm level, the alarm signal ALM is not output from the smoke detecting unit 52, and the monitoring is continued without performing a further operation.

If the received light level signal RLV is lowered to a level which is equal to or lower than the alarm level, the smoke detecting unit 52 outputs the alarm signal ALM to the warning circuit 12. When the alarm signal ALM is supplied to the warning circuit 12, the terminals 11*a* and 11*b* are short-circuited by the warning circuit 12 with a given predetermined impedance. Accordingly, a short-circuit current of a predetermined level flows through the sensor lines, so that the alarm can be detected by the receiver or the repeater on the side of the power supply.

(3) Light Generation Control Operation

If there is no change in the optical system after the monitoring operation is started, the sensor is kept to operate with the received light level signal RLV (=200) and the light generation control signal CTL (=200) at the point A on the solid line X in FIG. 3.

If the received light level from the reflector is lowered by, for example, dirt on the reflector, the characteristics of the sensor are changed as shown by the solid line Y in FIG. 3, and the received light level signal RLV for the light generation control signal CTL (=200) is lowered to be, for example, 198. When the light generation controlling unit 53 detects that the received light level signal RLV is lowered to a level which is lower than the reference level SLV (=200), the light generation control signal CTL is increased by, for example, 1, and the light generation control signal CTL having a digital value of 201 is output. Accordingly, the operation point is moved to the point B on the solid line Y in FIG. 3, and the value of the received light level signal RLV is, for example, 199.

If the received light level signal RLV is 199 when the light generation controlling unit 53 is restarted after an elapse of a time period (for example, ten minutes) which is sufficiently longer than the monitoring period (that is, three seconds) of the smoke detecting unit 52, the light generation control signal CTL is further increased by 1, and the light generation control signal CTL having a digital value of 202 is output. Accordingly, the operation point is moved to the point C on the solid line Y in FIG. 3, and the value of the received light level signal RLV is 200.

If the received light level signal RLV has the value of 200 when the light generation controlling unit 53 is started after a further elapse of ten minutes, the light generation control signal CTL is maintained to have the value (that is, 202).

For example, the case where the direction of the reflecting mirror in the installation is slightly deviated from the optical axis and, after the installation, the direction is caused to coincide with the normal optical axis by the deformation of the building or the like will be considered. In this case, when the received light level is increased, the characteristics are changed as shown by the solid line Z in FIG. 3. Therefore, the control is conversely performed so that the generated light level is lowered by the light generation control signal CTL, whereby the predetermined received light level is obtained.

As described above, the sensor of the embodiment comprises the light generation controlling unit 53 which controls the generated light level of the LED 30 so that the received light level coincides with the reference level SLV, and the driving unit 20 which controls the driving current of the LED 30 based on the light generation control signal CTL output from the light generation controlling unit 53. Thus, a smoke density can be detected by using the light at a received light level which is always constant, as a standard, thereby producing an advantage that a fire can be accurately judged on the basis of smoke.

In addition, the generated light level is controlled so that the predetermined received light level is maintained. Even when the directional adjustment in the installation is slightly deviated, therefore, the detection accuracy is not affected. Accordingly, the sensor has an advantage that the adjusting operation in the installation can be simplified.

The invention is not limited to the above-described embodiment and can be variously modified. For example, the following modifications (a) to (f) may be performed.

(a) The light generation control signal CTL and the received light level signal RLV-are digital values. Alternatively, analog voltages may be used.

(b) The circuit configuration of the driving unit 20 is not limited to the circuit shown in FIG. 1. Any circuit configuration may be adopted as far as it can output a driving current corresponding to the light generation control signal CTL.

(c) The light generating means is not limited to the LED 30. Alternatively, a light generating device of another kind such as a laser diode may be used.

(d) The smoke detecting unit 52 and the light generation controlling unit 53 are configured as individual controlling units. Alternatively, a single MPU may be configured so as to have both functions, or an MPU having an A/D function may be used.

(e) It is not required to periodically perform the monitoring of the received light level by the light generation controlling unit 53 at intervals of ten minutes. It is sufficient to perform the monitoring at an appropriate timing.

(f) The settings of the light generation control signal CTL and the reference level SLV are not limited to the values exemplarily shown in the embodiment. The values may be appropriately set in accordance with the circuit configuration and the like.

According to the present invention, the received light level in the light receiving means can be always kept at an appropriate level, and the judgment on a fire can be accurately performed on the light receiving side. In addition, since the generated light level is corrected, the sensor has an advantage that the adjustment in the installation can be simplified.

What is claimed is:

1. A light obstruction type smoke sensor comprising:

driving means for receiving a light generation control signal for a luminance control, and for outputting a driving current corresponding to said light generation control signal;

light generating means for outputting light of luminance corresponding to said driving current;

light receiving means for receiving light which is output from said light generating means and passes through a space of a monitoring area, and for outputting a level of said received light;

light generation controlling means for comparing said received light level with a predetermined reference level, for, when a difference of the levels is in an allowable range, increasing or decreasing said light generation control signal to reduce the level difference, and for outputting said light generation control signal; and smoke sensing means for detecting smoke in an optical path between said light generating means and said light receiving means based on said received light level, and for outputting an alarm signal when said received light level is equal to or lower than a predetermined alarm level.

* * * * *